US010151519B2

(12) United States Patent
Little et al.

(10) Patent No.: US 10,151,519 B2
(45) Date of Patent: Dec. 11, 2018

(54) DEVICES AND METHODS FOR MAKING SHAPED CLEAR ICE

(71) Applicant: Wintersmiths, LLC, Shelburne, VT (US)

(72) Inventors: Patrick William Little, Vienna, VA (US); Christopher Terence Little, Moretown, VT (US)

(73) Assignee: Wintersmiths, LLC, Shelburne, VT (US)

( * ) Notice: Subject to any disclaimer, the term of this patent is extended or adjusted under 35 U.S.C. 154(b) by 0 days.

(21) Appl. No.: 15/727,890

(22) Filed: Oct. 9, 2017

(65) Prior Publication Data

US 2018/0087817 A1 Mar. 29, 2018

Related U.S. Application Data

(63) Continuation-in-part of application No. 14/309,480, filed on Jun. 19, 2014, now Pat. No. 9,784,492.

(60) Provisional application No. 61/857,608, filed on Jul. 23, 2013.

(51) Int. Cl.

| | |
|---|---|
| ***F25C 1/18*** | (2006.01) |
| ***F25C 1/25*** | (2018.01) |
| ***F25C 1/22*** | (2018.01) |

(52) U.S. Cl.

CPC ..... *F25C 1/25* (2018.01); *F25C 1/18* (2013.01); *F25C 1/22* (2013.01); *F25D 2500/02* (2013.01)

(58) Field of Classification Search

CPC ..... F25C 1/18; F25C 1/22; F25C 1/25; F25D 2500/02

See application file for complete search history.

(56) References Cited

U.S. PATENT DOCUMENTS

| | | | | |
|---|---|---|---|---|
| 5,297,394 | A | 3/1994 | Frohbieter et al. | |
| 5,884,490 | A | 3/1999 | Whidden | |
| 6,345,802 | B2 * | 2/2002 | Moore | F25C 1/22 249/117 |
| 6,357,720 | B1 | 3/2002 | Shapiro et al. | |
| 6,857,277 | B2 | 2/2005 | Somura | |
| 6,935,124 | B2 | 8/2005 | Takahashi et al. | |
| 9,273,891 | B2 | 3/2016 | Boarman | |

(Continued)

OTHER PUBLICATIONS

Non-final Office Action dated Jul. 1, 2016, in connection with U.S. Appl. No. 14/309,480, filed Jun. 19, 2014.

(Continued)

*Primary Examiner* — Filip Zec

(74) *Attorney, Agent, or Firm* — Downs Rachlin Martin PLLC

(57) ABSTRACT

A clear-ice-making device that includes an insulated vessel and an ice mold that is engageable with a cavity of the insulated vessel in a manner that allows a user to rotate the ice mold about a central rotational axis to aid in removing the ice mold from the insulated vessel. In one embodiment, the ice mold includes one or more mold cavities that, when the ice mold is engaged with the insulated vessel, each fluidly communicate with a void beneath the ice mold and with an overfill region above that mold cavity. A method of making clear-ice shapes using a device having an ice mold rotatable within an insulated vessel is also disclosed, as is a method of instructing a user on how to perform the method of making clear-ice shapes.

20 Claims, 17 Drawing Sheets

(56) References Cited

U.S. PATENT DOCUMENTS

| | | | |
|---|---|---|---|
| 9,784,492 | B2 | 10/2017 | Little et al. |
| 2009/0152438 | A1 | 6/2009 | Chu |
| 2015/0027142 | A1 | 1/2015 | Little et al. |

OTHER PUBLICATIONS

Response to Non-Final Office Action dated Aug. 30, 2016, in connection with U.S. Appl. No. 14/309,480, filed Jun. 19, 2014.
Final Office Action dated Feb. 27, 2017, in connection with U.S. Appl. No. 14/309,480, filed Jun. 19, 2014.
Response to Final Office Action dated May 24, 2017, in connection with U.S. Appl. No. 14/309,480, filed Jun. 19, 2014.
Notice of Allowance dated Jun. 6, 2017, in connection with U.S. Appl. No. 14/309,480, filed Jun. 19, 2014.

* cited by examiner

DEVICES AND METHODS FOR MAKING SHAPED CLEAR ICE

RELATED APPLICATION DATA

This application is a continuation-in-part of U.S. patent application Ser. No. 14/309,480, filed Jun. 19, 2014, and titled "DEVICE AND METHOD FOR PRODUCING CLEAR ICE SHAPES", now U.S. Pat. No. 9,784,492, which claims the benefit of priority of U.S. Provisional Patent Application Ser. No. 61/857,608, filed on Jul. 23, 2013, and titled "DEVICE AND METHOD FOR PRODUCING CLEAR ICE SPHERES". Each of these applications is incorporated by reference herein in its entirety.

FIELD OF THE INVENTION

The present invention generally relates to the field of ice making. In particular, the present invention is directed to devices and methods for making shaped clear ice.

BACKGROUND

Standard ice cubes are typically opaque and melt quickly in beverages resulting in a warm drink with a watered down taste. Clear ice spheres can ameliorate both problems.

SUMMARY OF THE DISCLOSURE

In one implementation, the present disclosure is directed to a device for making shaped clear ice from a clear liquid. The device includes an insulated vessel that includes insulated sides, an insulated bottom, and an open top, wherein the insulated sides and bottom define a vessel cavity having a depth; an ice mold engageable into the vessel cavity through the open top of the insulated vessel, the ice mold including first and second mold parts that releasably engage one another to define at least one mold cavity that shapes the shaped clear ice upon freezing of the clear liquid within the at least one mold cavity; an upper exterior end wall, the upper end having an upper opening allowing fluid communication through the upper exterior end wall to the at least one mold cavity for receiving the clear liquid during filling of the at least one mold cavity; a lower exterior end wall spaced from the upper exterior end wall by a distance less than the vertical depth of the vessel cavity of the insulated vessel, the lower exterior end wall having lower opening allowing fluid communication through the lower exterior end wall to the at least one mold cavity; a central rotational axis; a lateral exterior extending between the upper and lower exterior end walls, the lateral exterior configured so that when the ice mold is engaged with the vessel cavity for ice-making, the ice mold is rotatable about the central rotational axis; and means that allow a user to rotate the ice mold relative to the insulated vessel about the central rotational axis while the ice mold is engaged in the vessel cavity; wherein, when the ice mold is fully engaged in the vessel cavity, the lower exterior end of the ice mold is spaced from the insulated bottom so as to leave a void in the vessel cavity in which cloudy ice forms as a result of forming of the shaped clear ice within the at least one mold cavity.

In another implementation, the present disclosure is directed to a method of making shaped clear ice. The method includes filling, with a clear liquid a mold cavity of an ice mold that is engaged with a vessel cavity of an insulated vessel; and a void in fluid communication with the mold cavity and located in the vessel cavity beneath the mold cavity; placing the ice mold and the insulated vessel in a frigid environment so that an entirety of the clear liquid in the mold cavity freezes; removing the ice mold and the insulated vessel from the frigid environment; while the ice mold remains engaged with the vessel cavity, causing rotational movement between the ice mold and the insulated vessel to break a connection between ice in the mold cavity and ice in the void; and extracting the shaped clear ice from the ice mold.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

The following detailed description is of the several example embodiments. The description is not to be taken in a limiting sense, but is made merely for the purpose of illustrating the general principles of aspects of the invention, since the scope of these aspects of the invention is best defined by the appended claims. Broadly, an embodiment of the present invention provides a device and method for producing clear ice shapes that may include two half molds that fit together and an insulated vessel wherein the half molds may be placed inside an upper portion of the insulated vessel, leaving a hollow space in a lower portion.

Figure 1:
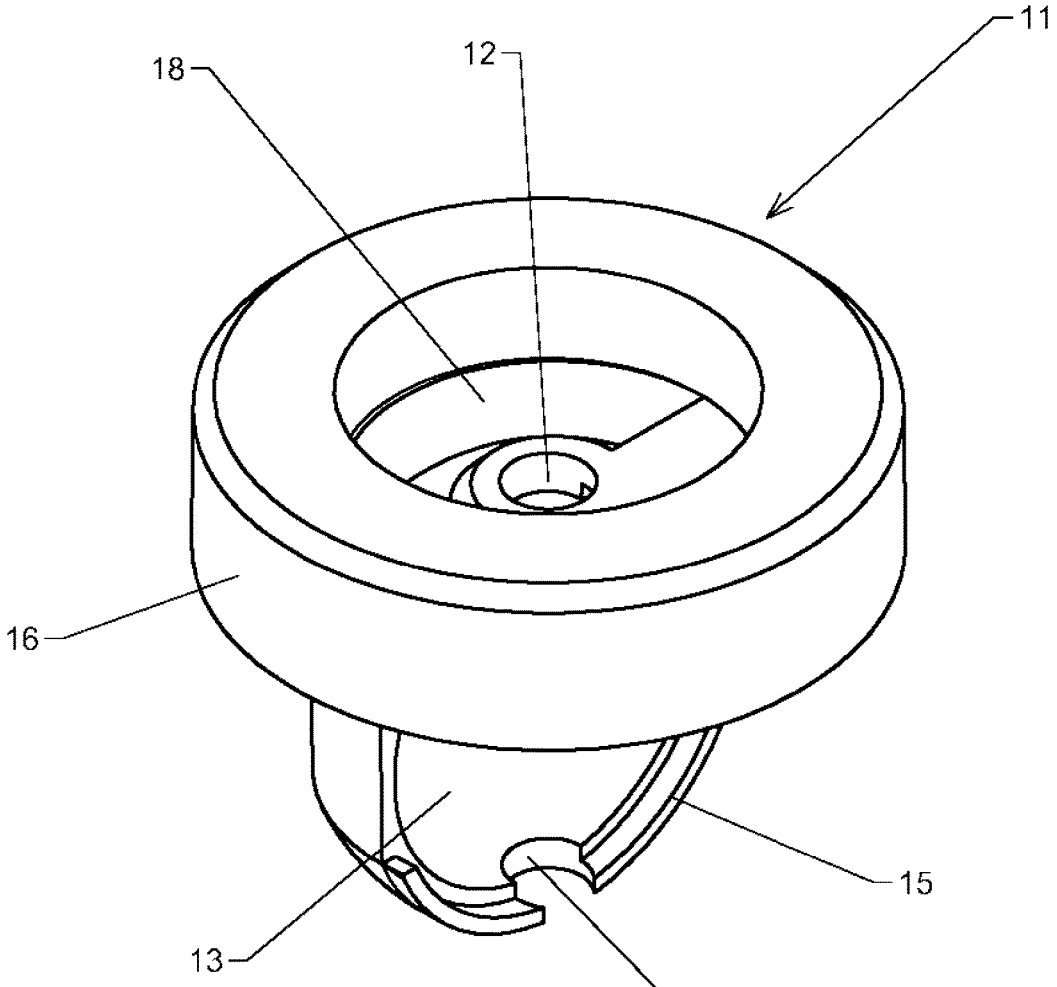
FIG. 1 is a right side perspective view of the top of an example embodiment of the Large Mold Assembly.
Figure 2:
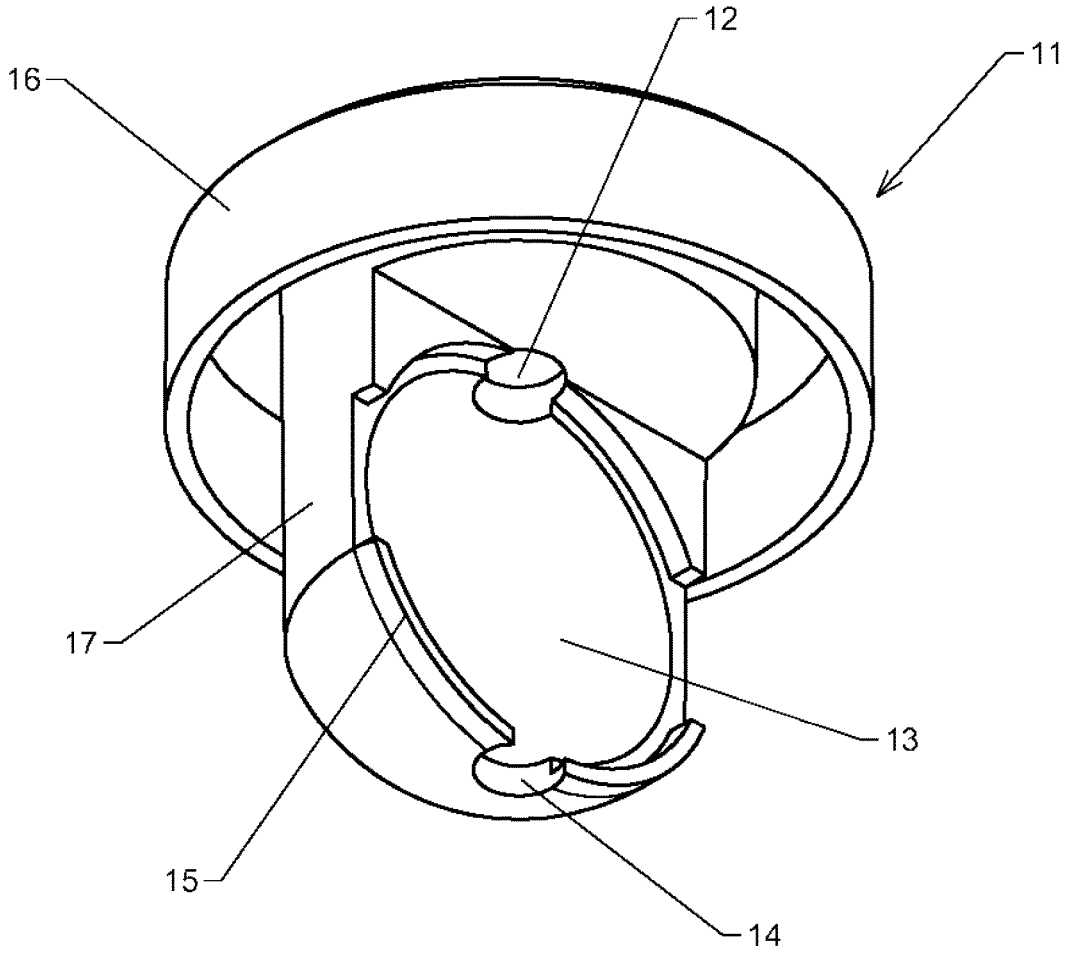
FIG. 2 is a right side perspective view of the bottom of an example embodiment of the Large Half Mold.

One example embodiment that includes a large half mold 11 is illustrated in FIGS. 1 and 2. Large half mold 11 is made from a material rigid enough to grip and turn with minimal compression or distortion. This grippability and turnability can be leveraged in a process of removing a frozen ice shape from the overall mold cavity. One example embodiment is made with plastic, but numerous other materials are possible. FIGS. 1 and 2 show large half mold 11 as including a large half mold fill hole 12 which is below the top of a cap 16, but above an overfill cavity 18, preventing excess liquid from spilling over the of the device. Large half mold fill hole 12 connects to a large half mold semi-spherical cavity 13, which connects to a large half mold exit hole 14 at the center of the bottom of large half mold 11. A large half mold semi-spherical cavity 13 has an outer flange 15 extending from its face.

Figure 3:
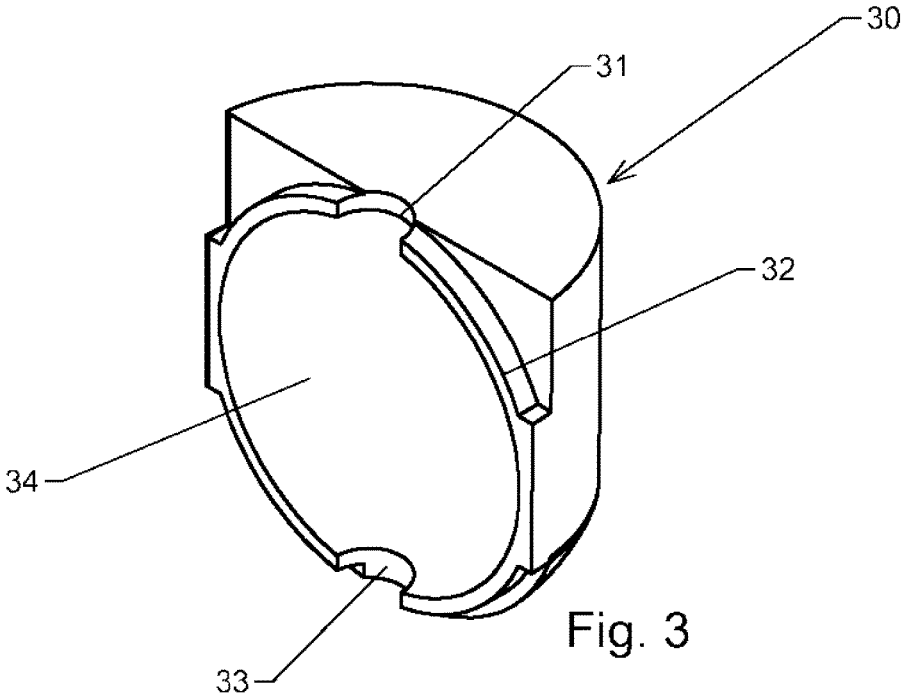
FIG. 3 is a left side perspective view of the top of an example embodiment of the Small Half Mold.
Figure 4:
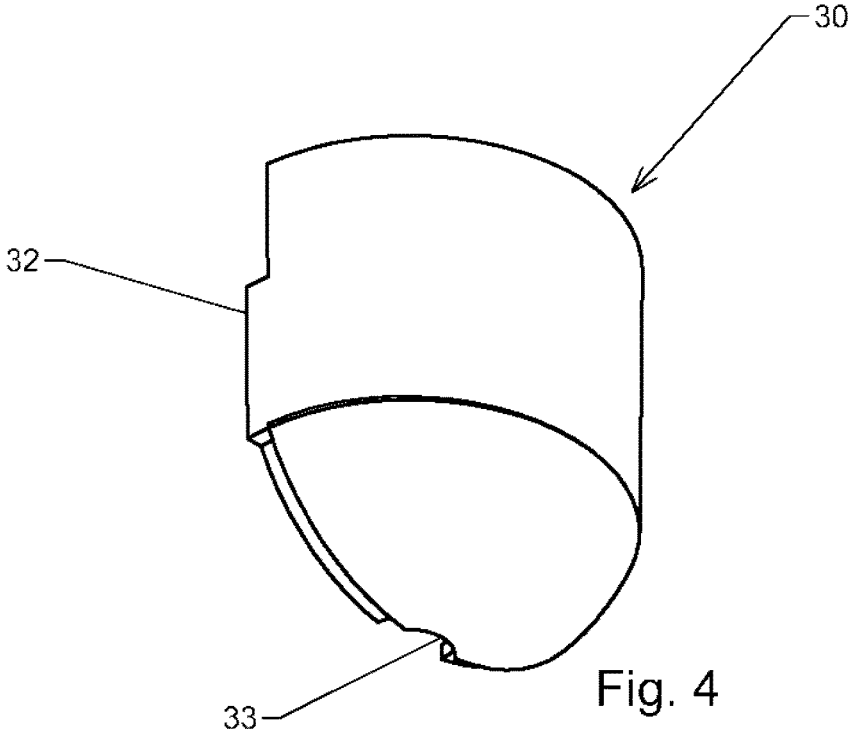
FIG. 4 is a right side perspective view of the bottom of an example embodiment of the Small Half Mold.

FIGS. 3 and 4 illustrate an example embodiment of a small half mold 30 which may be made from a material more flexible than large half mold 11; one example embodiment is made with silicone rubber, but numerous other materials are possible. FIGS. 1 and 2 show a small half mold fill hole 31 connecting to a small half mold semi-spherical cavity 34 which then connects to a small half mold exit hole 33 at the center of the bottom of small half mold 30. An inner flange 32 extends from the face of small half mold semi-spherical cavity 34.

Figure 5:
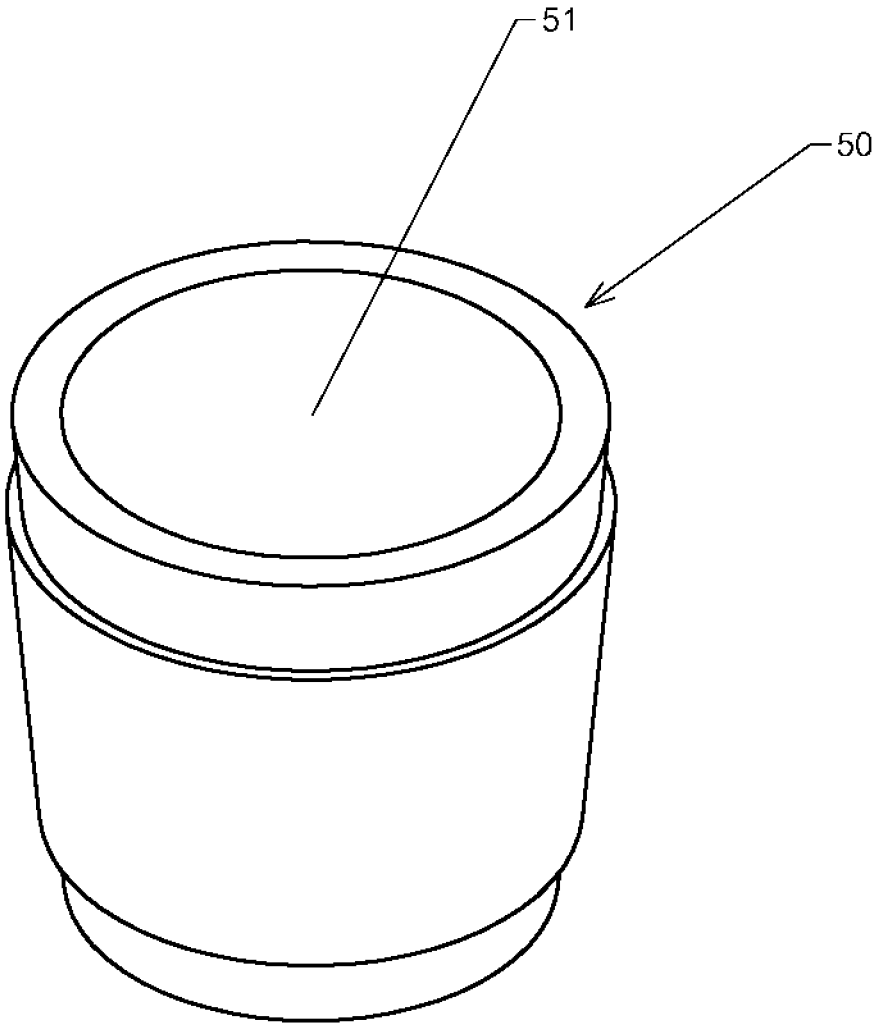
FIG. 5 is a right side perspective view of the top of an example embodiment of the Cup.
Figure 6:
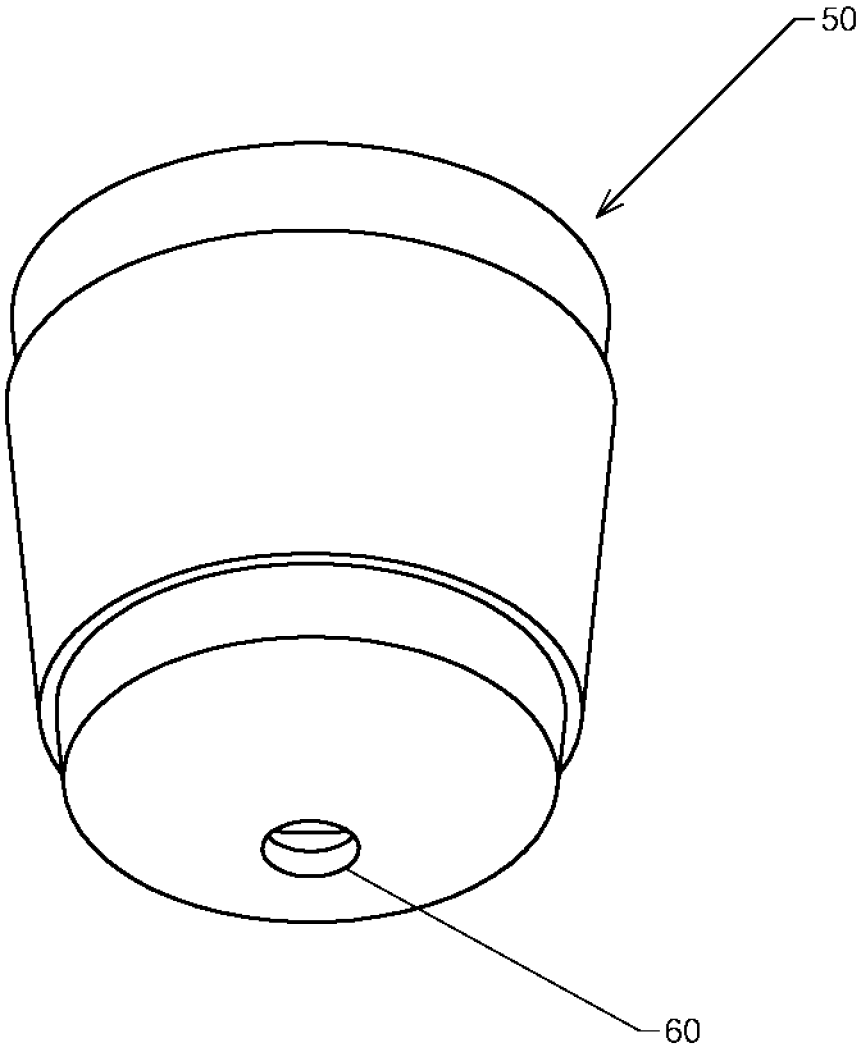
FIG. 6 is a right side perspective view of the bottom of an example embodiment of the Cup.

A cup 50 for receiving the large and small half molds 11 and 30 when mated together is illustrated in FIGS. 5 and 6 and is made from a flexible material; one example embodiment is made from silicone rubber that is more flexible than small half mold 30. FIG. 5 shows cup 50 has having a cup cavity 51, which is the same shape and depth as small half mold 30 and the lower section of large half mold 11 when the molds are mated together to prevent the two half molds from being forced apart as liquid freezes in the spherical cavity they create. FIG. 6 shows a cup exit hole 60 at the center of the bottom of cup 50 connecting to cup cavity 51 (not visible in FIG. 6) and aligning with small half mold exit hole 33 and large half mold exit hole 14.

Figure 7:
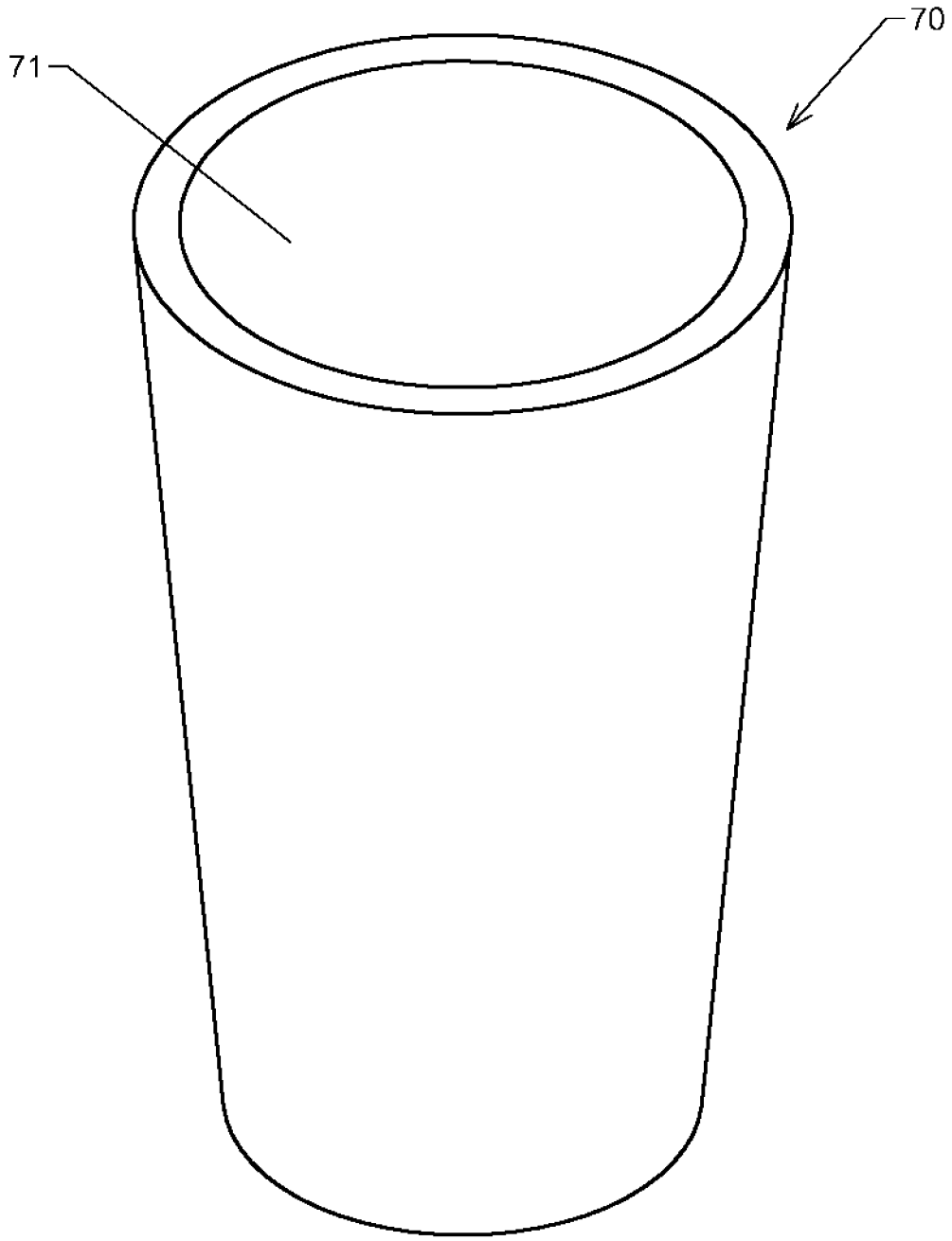
FIG. 7 is a right side perspective view of the top of an example embodiment of the Insulated Vessel.

FIG. 7 illustrates an example embodiment of an insulated vessel 70, which can be made from any material having insulating properties. One example embodiment is made with a double-walled stainless steel insulated vessel similar to travel mugs used to maintain the temperature of hot or cold liquids, but numerous other materials are possible. FIG. 7 shows insulated vessel 70 as having an insulated vessel cavity 71, which is the same shape as cup 50, but extends deeper than the bottom of cup 50. One example embodiment is roughly 7 inches deep to produce an ice ball roughly 2.4 inches in diameter in air temperature of 0 degrees Fahrenheit, but the depth of insulated vessel 70 may vary to produce clear ice depending on the ice shape size and air temperature among other things. Insulated vessel 70 has a solid bottom (i.e. there is no exit hole as with cup 50, small half mold 30 or large half mold 11).

Figure 8:
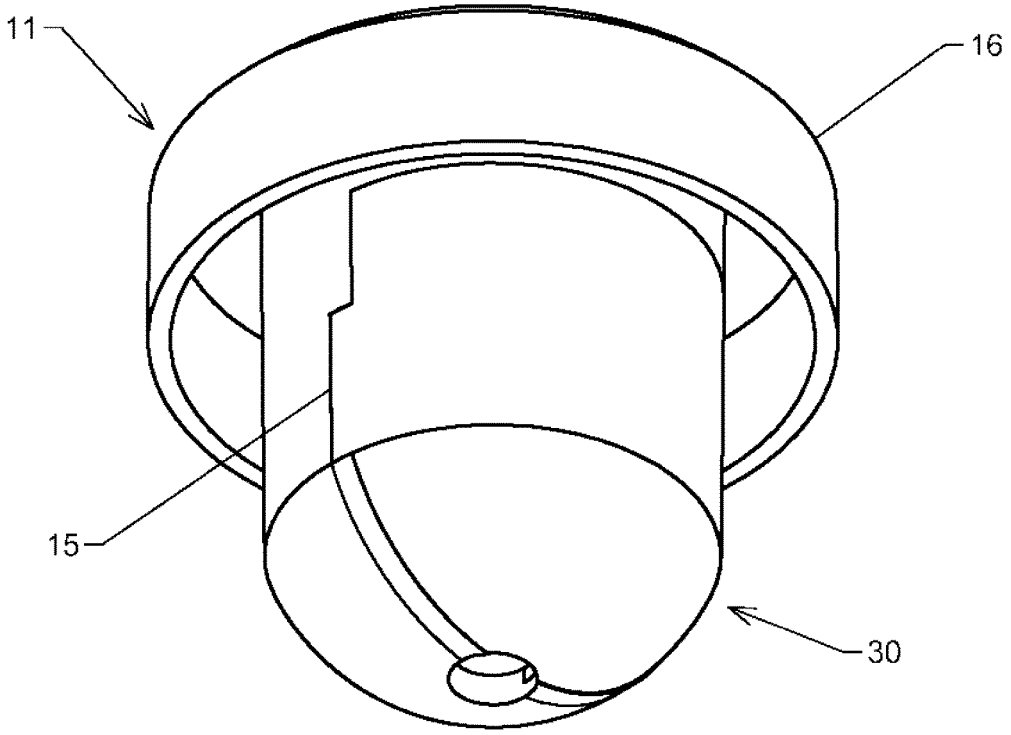
FIG. 8 is a right side perspective view of the bottom of an example embodiment of the Large Half Mold and a left side perspective of the bottom of an example embodiment of the Small Half Mold showing the two half molds assembled together.
Figure 9:
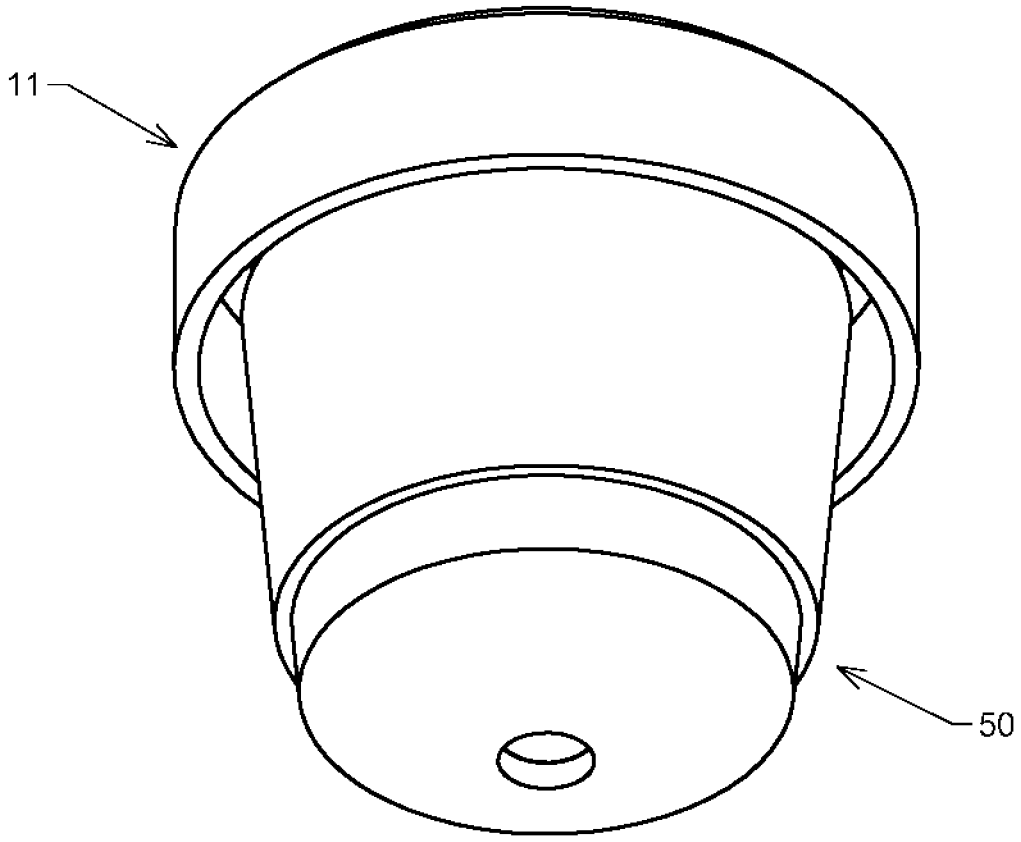
FIG. 9 is a right side perspective of the bottom of an example embodiment of the Cup assembled together with the Large and Small Half Mold assembly.
Figure 10:
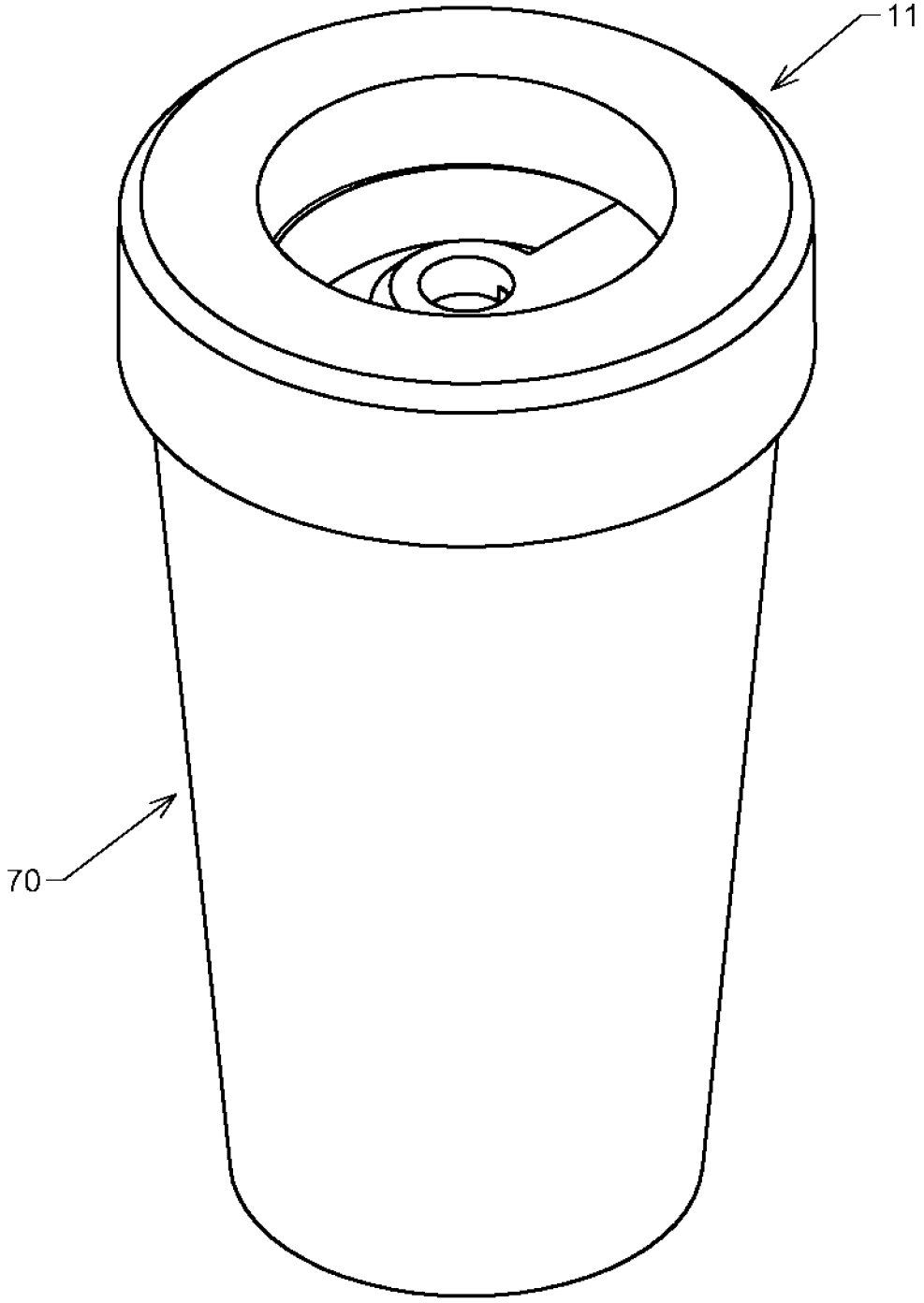
FIG. 10 is a right side view of the bottom of an example embodiment of the Insulated Vessel assembled together with the Cup and the Large and Small Half Mold assemblies.

FIGS. 8-10 illustrate how example embodiments of the parts are assembled into an example embodiment of the device. FIG. 8 shows small half mold 30 mated with large half mold 11 at outer flange 15 to form a cylindrical outer shape below cap 16 with a spherical cavity inside the cylinder. Outer flange 15 interlocks with inner flange 32. FIG. 9 shows small half mold 30 mated with large half mold 11 and inserted into cup cavity 51. FIG. 10 shows small half mold 30 mated with large half mold 11, inserted into cup cavity 51 and then inserted into insulated vessel cavity 71.

Operation

Operation of the example device described above requires assembly of the device, filling and freezing a liquid in the device, and finally extracting the resulting clear ice ball.

Assembly of the device is illustrated in FIGS. 8-10. Small half mold 30 is pressed together with large half mold 11 such that outer flange 15 interlocks with inner flange 32. The material flexibility of small half mold 30 allows it to snap into place with minimal effort. Holding cap 16, the cylindrical shape created by mating the two half molds is pressed down into cup cavity 51 until the top of cup 50 reaches the underside of cap 16. Finally the half molds and cup 50 are pressed down into insulated vessel cavity 71 until the top of insulated vessel 70 reaches the bottom of cap 16.

With the device assembled, it can be filled with liquid, typically water, but any liquid that will freeze at normal food-type freezer temperatures (e.g., 0 degrees Fahrenheit) may be used. The liquid may be slowly poured into large half mold fill hole 12 until it rises above the hole and into overfill cavity 18. The filled vessel may be shaken, tapped, or otherwise agitated to release trapped air; additional liquid may need to be added if the liquid level drops below large half mold fill hole 12 after any air is released. Once filled the device is submitted to temperatures below the freezing point of the liquid. Insulated vessel 70 prevents the liquid from freezing on all sides, which would trap gases and impurities. Only the top of the device is unprotected from the freezing temperatures; thus the liquid freezes from the top down with liquid at the bottom of insulated vessel 70 freezing last. This forces gases and impurities downward and out of the spherical cavity through the exit holes and into the unfrozen liquid, leaving a crystal clear ice sphere in the spherical cavity and a mass of cloudy ice in the lower section of insulated vessel cavity 71.

Once the liquid in the spherical mold cavity is frozen, the clear ice sphere may be removed. First the two half molds and cup 50 are removed. This is accomplished by either lifting the assembly out of insulated vessel 70 by cap 16 or by rotating cap 16 while keeping insulated vessel 70 fixed to break cup 50 free from ice formed in the lower section of insulated vessel 70. Warm liquid may be used to expedite or ease this extraction. Next, the two half molds may be removed from cup 50 by either lifting them out by cap 16 or by again rotating cap 16 while fixing cup 50 to break the half molds free from any ice formed between cup 50 and the two half molds. Again warm liquid may be used to expedite or ease this extraction. Lastly, small half mold 30 is removed from large half mold 11 by pulling small half mold 30 away starting from large half mold 11 at small half mold exit hole 33. Again warm liquid may be used to expedite or ease this extraction. The clear ice sphere may now be removed from the device.

Additional Embodiments

One example additional embodiment deletes cup 50 from the device and modifies the shape of insulated vessel cavity 71 to conform to the shape of the two half molds mated together (a cylinder in the example embodiment illustrated in FIG. 8). The operation of the device remains unchanged excepting the steps involving cup 50. Other embodiments of small half mold 30 and large half mold 11, which are oriented vertically when mated in the example embodiment illustrated in FIG. 8, may be oriented horizontally or at any other angle when mated.

FIGS. 11A to 11H illustrate an example embodiment of a clear-ice-making device 1100 that includes an insulated vessel 1104 and an ice mold 1108 having multiple mold cavities, wherein the clear-ice-making device is configured for assisting a user in removing the ice mold from the insulated vessel and, particularly, the ice that will typically form in the void 1104A (FIGS. 11C and 11D) during use of the device to form clear-ice shapes. In the example shown, ice mold 1108 forms seven mold cavities formed within an upper half-mold 1108U (FIGS. 11C to 11F) and a lower half-mold 1108L (FIGS. 11C, 11D, 11G, and 11H) by way of partial cavities 1108U(1) to 1108U(7) (FIG. 11F) and 1108L(1) to 1108L(7) (FIG. 11G), respectively, when the mold halves are coupled to one another to form the ice mold, as seen in each of FIGS. 11C and 11D. In this embodiment each of the seven mold cavities is spherical in shape, though in other embodiments they may have other shapes, for example, cubic, rectangular, discoid, ovoid, cone shaped, etc., and the shapes may differ among the total number of mold cavities provided. Fundamentally, there is no limitation on the shape(s) of the mold cavities other than each shape allows for de-molding (extraction). That said, spheres for ice is often preferred due to spheres having the least surface area for the same volume, and having the least surface area provides less area exposed to melting temperatures. Also, while seven mold cavities are shown, alternative embodiments can have fewer or more mold cavities, depending on the design desired.

In the example shown, upper and lower half molds 1108U and 1108L are coupled together by a pair of coupling mechanisms, each of which includes a catch structure 1112(1) and 1112(2) (FIGS. 11E and 11F) and a corresponding receiver 1116(1) and 1116(2) (FIGS. 11G and 11F) that engage one another to lock the half molds together. It is noted that in other embodiments, more than two coupling mechanisms may be provided, and in other embodiments each coupling mechanism may be replaced with another type of coupling mechanism. In this example, each receiver 1116(1) and 1116(2) includes a recess 1116(1)A and 1116(2)A that tightly receives a vertical portion of corresponding catch structure 1112(1) and 1112(2) with a close fit. This manner of engagement is beneficial in the process of removing ice mold 1108 from insulated vessel 1104 described below, which requires that upper mold half 1108U and lower mold half 1108L rotate together as a unit about a central rotational axis 1118 (FIG. 11A) when a user applies rotational forces to the ice mold. Each catch structure 1112(1) and 1112(2) includes a catch 1112(1)A and 1112(2)A that hooks around a lower end of corresponding receiver 1116(1) and 1116(2).

In this embodiment, upper half mold 1108U includes a set of hooks 1120(1) to 1120(4) that generally provide several functions: 1) they vertically suspend ice mold 1108 in a cavity 1104B of an insulated vessel 1104, 2) they provide grips that help a user to insert and remove the ice mold from the cavity of the insulated vessel, and 3) they provide handles that allow a user to rotate the ice mold relative to the insulated vessel during the process of extracting the ice spheres from clear-ice-making device 1100. Regarding the last function, the extraction process is described in detail below. It is noted that fewer or more than four hooks 1120(1) to 1120(4) can be provided and that the hooks can be replaced with other structures that provide one or more of the three functions mentioned above. Regarding those three functions, it is noted that a single structure or portion can provide all three, two of the three, or only one, depending on the design. For example, the upper end of upper half mold 1108U may be provided with a central handle that provides functions 2 and 3, while hooks 1120(1) to 1120(4) or other peripheral structure that overhangs the upper end 1104C of the exterior sidewall 1104D of insulated vessel 1104, such as a flange, provides function 1. In other embodiments, function 1 may be provided by a structure other than a structure that overhangs exterior sidewall 1104D of insulated vessel 1104, such as a step (not shown) on the interior of the exterior wall on which the lower end of lower half mold 1108L sits or a pylon (not shown) that projects up from the bottom wall 1104E of the insulated vessel, among others.

In this example, lower half mold 1108L includes seven lower openings 1124(1) to 1124(7) (FIG. 11H) corresponding to respective of the seven mold cavities. This allows water or other liquid from which the ice spheres will be made to flow into or out of the mold cavities. Upper half mold 1108U also includes seven upper openings 1128(1) to 1128(7) (FIG. 11E), one for each of the seven mold cavities. Lower openings 1128(1) to 1128(7) also allow water or other liquid to flow into or out of the mold cavities. Each upper opening 1128(1) to 1128(7) is surrounded by containment wall 1132(1) to 1132(7) (FIG. 11E) that defines an overfill region 1136(1) to 1136(7) that allows a user to overfill each mold cavity to ensure that the ice shapes, here ice spheres, are fully formed, while not requiring an inordinate amount of overfill volume. The seven overfill regions 1136(1) to 1136(7) in this example are a function of the design of upper mold half 1108U. In other embodiments, the design option of one overfill region per mold cavity can be replaced with another design option, such as a single overfill region for all mold cavities or multiple overfill regions, with each overfill region serving two or more mold cavities, among other options. It is noted that upper and lower half molds 1108U and 1108L can be made of one or more suitable materials, such as polymer plastic, rubber, and/or metal, among others.

Regarding filling clear-ice-making device 1100 with the liquid to be frozen, filling may be accomplished in any of a number of ways. For example, with ice mold 1108 removed from insulated vessel 1104, a user may fill the insulated vessel with the liquid to a level close to the top of the insulated vessel. Then, the user can install ice mold 1108 into insulated vessel 1104 slowly so as to let the liquid flow into the mold cavities through lower openings 1124(1) to 1124(4). If the liquid does not come out of upper openings 1128(1) to 1128(7), the user may then add more liquid to each overfill region 1136(1) to 1136(7) and allow it to flow into the mold cavities through the upper openings until some amount of the liquid remains in the overfill regions. As another example, with ice mold 1108 removed from insulated vessel, a user may fill the insulated vessel with liquid to a lower level, say to a level roughly where the bottom of the ice mold will be when fully inserted into the insulated vessel. Then, the user may install ice mold 1108 into insulated vessel 1104 and add liquid through upper openings 1128(1) to 1128(7) until some amount of liquid remains in each overfill region 1136(1) to 1136(7). As yet another example, with insulated vessel 1104 and ice mold 1108 empty and the ice mold installed into the insulated vessel, a user can fill both void 1104A below the ice mold and all of the mold cavities with the desired liquid through upper openings 1128(1) to 1128(7) until some amount of the liquid remains in each of overfill regions 1136(1) to 1136(7). Once clear-ice-making device 1100 is properly filled, the user can place it into a freezing environment.

As described above relative to the device illustrated in FIGS. 1 to 10, the extraction of the ice sphere is aided by the rotation of the joined large and small half molds 11, 30 relative to cup 50 and insulated vessel 70 so as to break the joined half molds, and the clear ice sphere contained therein, free from ice in cup exit hole 60 and/or in large and small half mold exit holes 14, 33 that initially connects the ice sphere within the mold cavity to the ice in the lower space of vessel cavity 71 beneath the joined half molds. This initial breaking of the ice connecting the clear ice sphere from the cloudy ice in the lower space of vessel cavity 71 makes the process of extracting the clear ice sphere from the device easier for the user. Clear-ice-making device 1100 of FIGS. 11A to 11H is designed to function in the same manner.

In clear-ice-making device 1100, the transverse cross-sectional shape of cavity 1104B of insulated vessel 1104 and the transverse cross-sectional shape of ice mold 1108 are circular to allow a user to rotate the mold relative to the insulated vessel about central rotational axis 1118 after freezing so as to break the ice connections between the ice spheres (not shown) within the seven mold cavities and the ice (not shown) within void 1104A of the insulated vessel beneath the mold. After removing clear-ice-making device 1100 from a freezing environment, a first step in the process of extracting the clear ice sphere from mold 1108 can be to rotate the mold relative to insulate vessel 1104 so as to break the ice connections. This breaking generally occurs at the bottom of the exterior of lower half mold 1108L at the lower end of each lower opening 1124(1) to 1124(7) (FIG. 11H). This will leave a small nub of ice on each clear ice sphere from the ice remaining in the corresponding lower opening 1124(1) to 1124(7). The thinner lower half mold 1108L is at its bottom where lower openings 1124(1) to 1124(7) are located, the thinner this nub will be.

It is recognized that the hemispherical shape of the bottom side of lower half mold 1108L as seen in FIG. 11H might, when the liquid within the seven cavities and within void 1104A during use of clear-ice-making device 1100 (FIG. 11A), tend to cause a mechanical interlock between the ice mold and the ice within void 1104A such that when a user tries to rotate the ice mold to break the ice connections at lower openings 1124(1) to 1124(7) the ice in the void will tend to rotate with the ice mold. However, it has been found that the curved surfaces of the hemispheres on the underside of lower half mold 1108L also tend to slide on the ice formed within void 1104A when a user applies a rotational force to ice mold 1108. This sliding tends to cause not only shear forces within the ice connections in lower openings 1124(1) to 1124(7), but also tensile forces as ice mold 1108 slides up the inclined contacting surfaces between lower half mold 1108L and the ice within void 1104A.

Figure 11A:
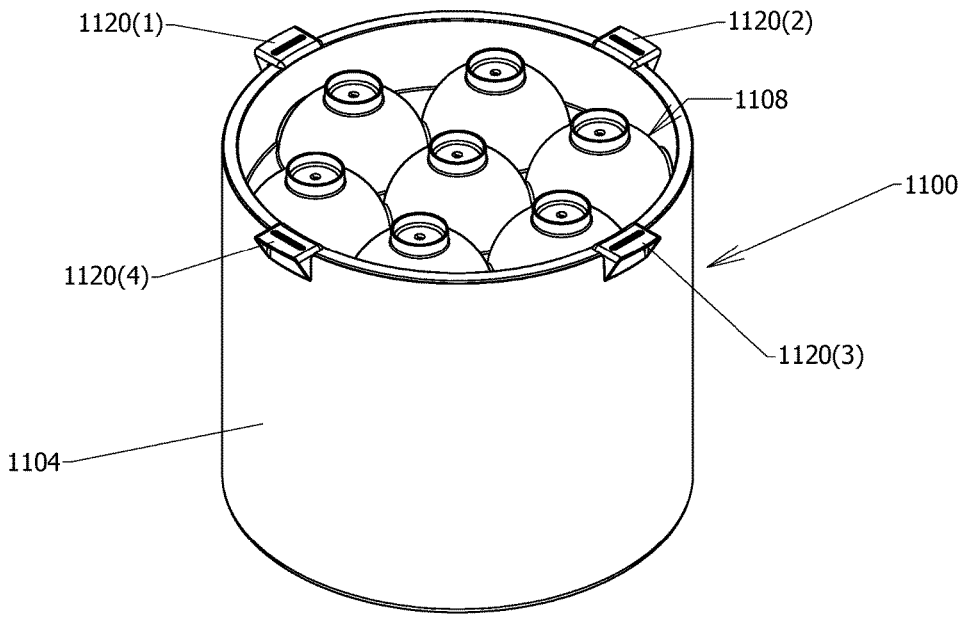
FIG. 11A is an isometric view of an alternative clear-ice-making device made in accordance with the present invention.
Figure 11B:
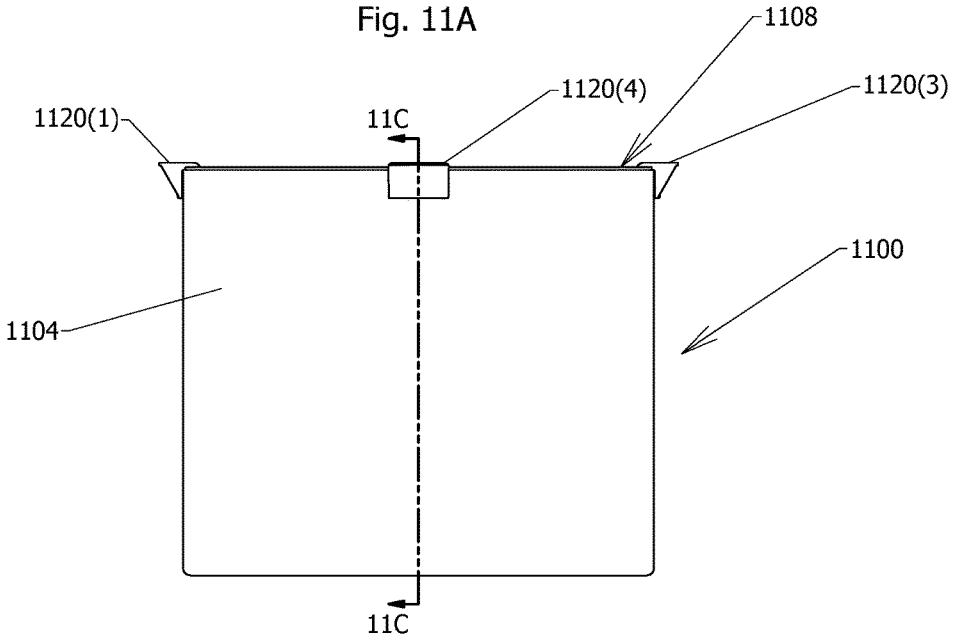
FIG. 11B is an elevational view of the clear-ice-making device of FIG. 11A.
Figure 11C:
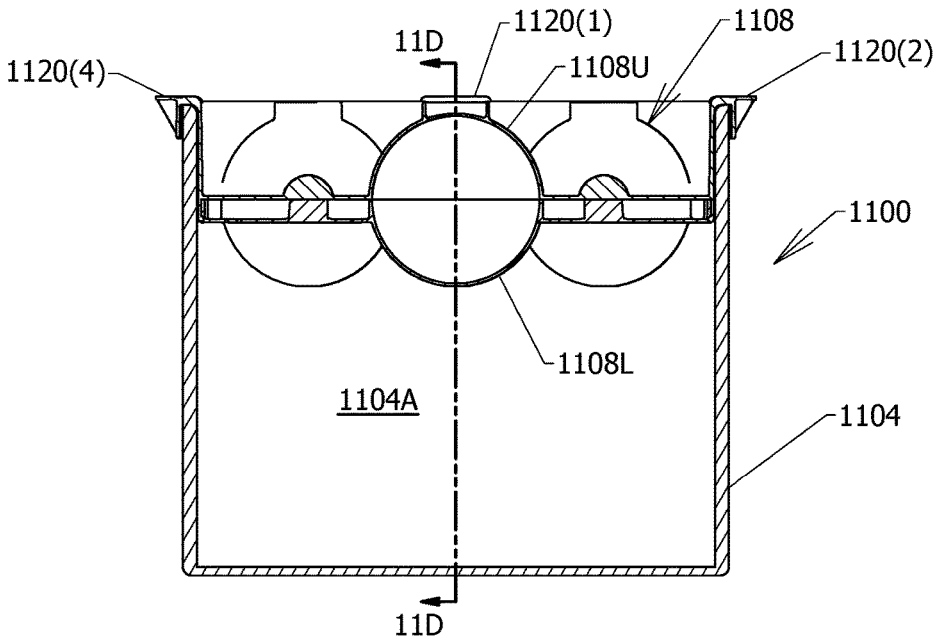
FIG. 11C is cross-section of the clear-ice-making device of FIG. 11A as taken along line 11C-11C of FIG. 11B.
Figure 11D:
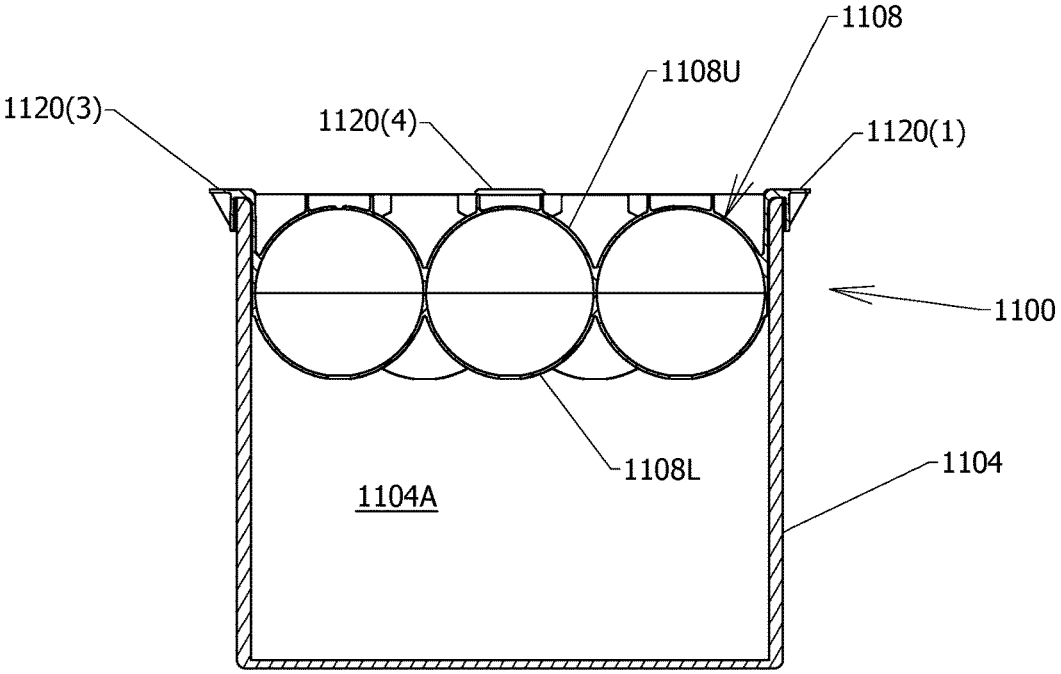
FIG. 11D is a cross-sectional view of the clear-ice-making device of FIG. 11A as taken along line 11D-11D of FIG. 11C.
Figure 11E:
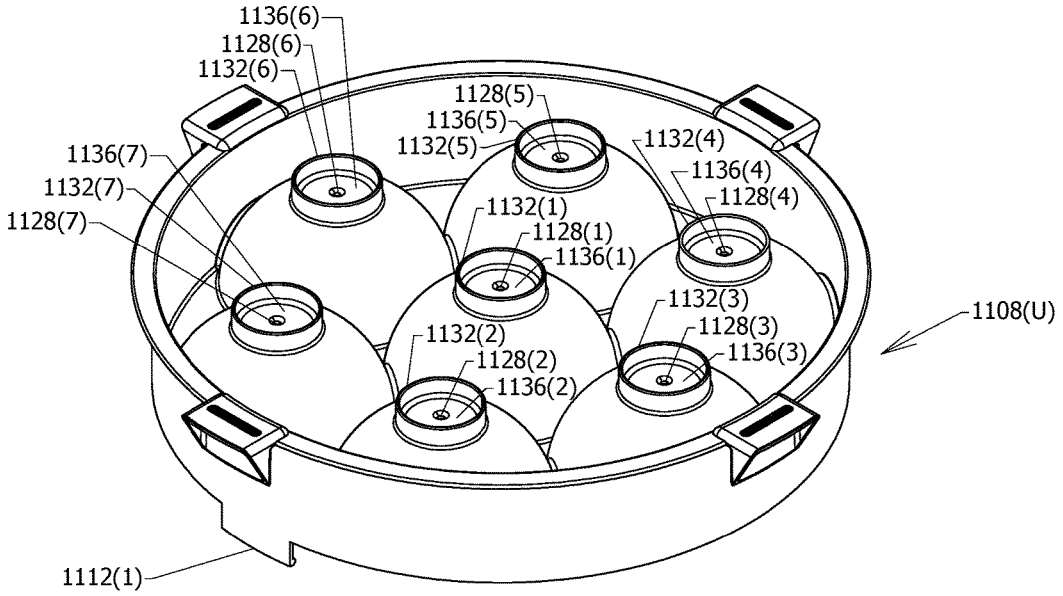
FIG. 11E is an enlarged top isometric view of the upper half mold of the ice mold of FIG. 11A.
Figure 11F:
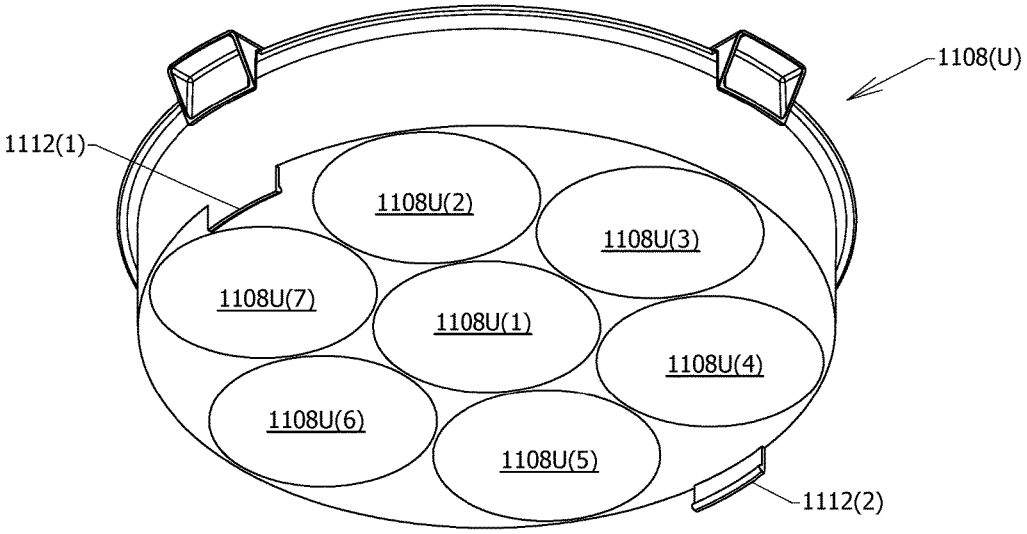
FIG. 11F is an enlarged bottom isometric view of the upper half mold of the ice mold of FIG. 11A.
Figure 11G:
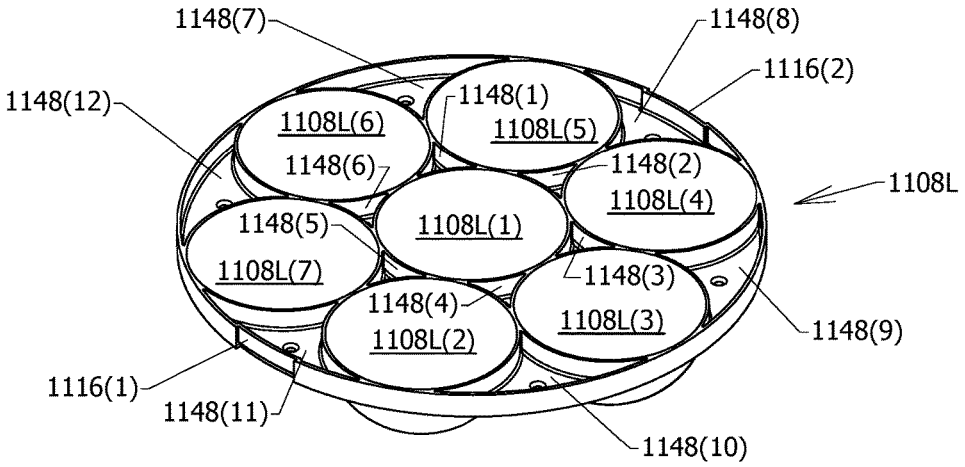
FIG. 11G is an enlarged top isometric view of the lower half mold of the ice mold of FIG. 11A.
Figure 11H:
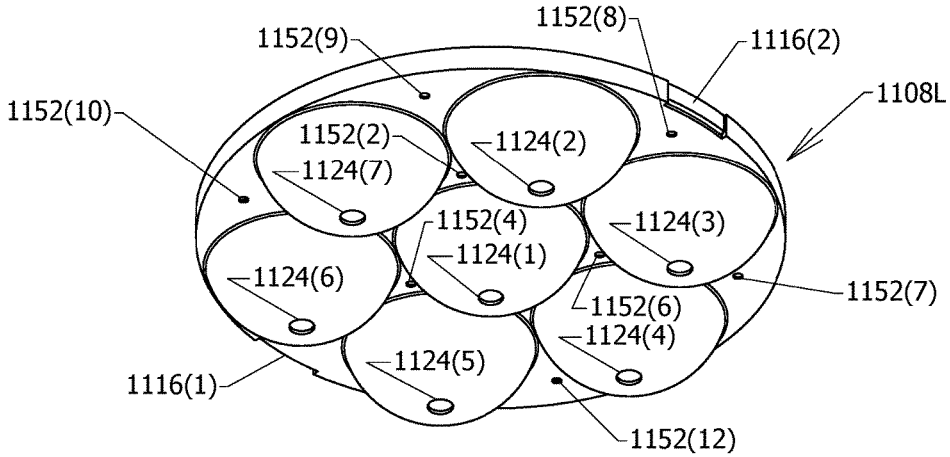
FIG. 11H is an enlarged bottom isometric view of the lower half mold of the ice mold of FIG. 11A.
Figure 11I:
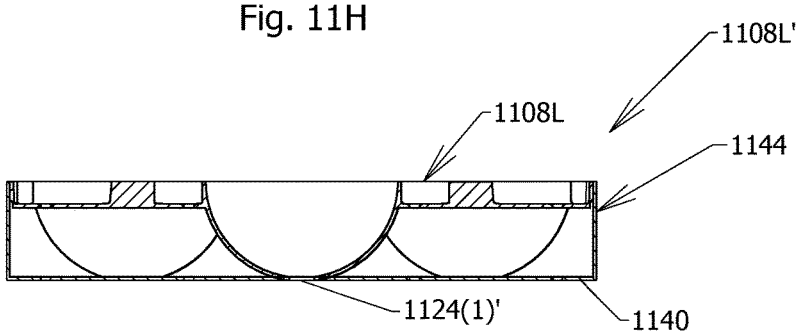
FIG. 11I is a cross-sectional view of an alternative lower half mold that can be used with the upper half mold of FIGS. 11E and 11F.

FIG. 11I illustrates an alternative lower half mold 1108L' that is identical to lower half mold 1108L of FIGS. 11C, 11D, 11G, and 11H except that it includes a bottom surface 1140 that is flat. This flatness eliminates any issues that mechanical interlock between the ice mold (not shown but similar to ice mold 1108 of FIG. 11A) and the ice with the void beneath the ice mold, such as void 1104A of FIG. 11A. Thus, aside from adhesion between lower half mold 1108L' and the ice within the void below the lower half mold during use, generally the only resistance to rotation of the overall ice mold (not shown) is the ice connections at lower openings 1124(1)' to 1124(7)' (only one shown in FIG. 11I) between the ice in the mold cavities and the ice in the void below. In the example shown, flat bottom surface 1140 is provided by adding a generally circular apertured pan-shaped member 1144 to lower half mold 1108L of FIGS. 11C, 11D, 11G, and 11H. In other embodiments, flat bottom surface 1140 can be provided in any suitable manner, such as forming mold cavities in a solid block of flat-bottomed material, among others.

As also seen in FIG. 11G, lower half mold 1108L includes a plurality of spaces 1148(1) to 1148(12) that, when the lower half mold is mated to a corresponding upper half mold, such as upper half mold 1108U of FIGS. 11E and 11F, form corresponding dead spaces (not shown). In this example, lower half mold 1108L includes a plurality of lower openings 1152(1) to 1152(12) (only some labeled to avoid clutter) that, when ice mold 1108 (FIG. 11A) is engaged in insulated vessel 1104, allows liquid to flow into the dead spaces from void 1104A to reduce the buoyancy of the ice mold.

It is noted that in this example, the transverse cross-sectional shape of the exterior of insulated vessel 1104 is circular so as to provide an exterior sidewall with a uniform thickness around the circumference of the insulated vessel. However, in other embodiments, the transverse cross-sectional shape may be any shape desired. For the rotate-to-break-ice-connection feature, all that is needed is for cavity 1104A to have a circular transverse cross-sectional shape where mold 1112 confronts the interior surface of the external sidewall.

It is noted that a method of the present disclosure can include providing instructions to a user on how to fill a clear-ice-making device of the present disclosure, such as any one of the clear-ice-making devices shown in the accompanying figures, with a clear liquid, how to cause the clear liquid to freeze, and how to free the ice mold from the insulated vessel and extract the one or more clear-ice shapes from the ice mold. Such instructions can be provided in any suitable manner, such as on an instruction sheet accompanying an instantiation of the clear-ice-making device, via an instruction set printed on or otherwise provide on an instantiation of the clear-ice-making device, via an instructional audio and/or video, among others.

Figure 12A:
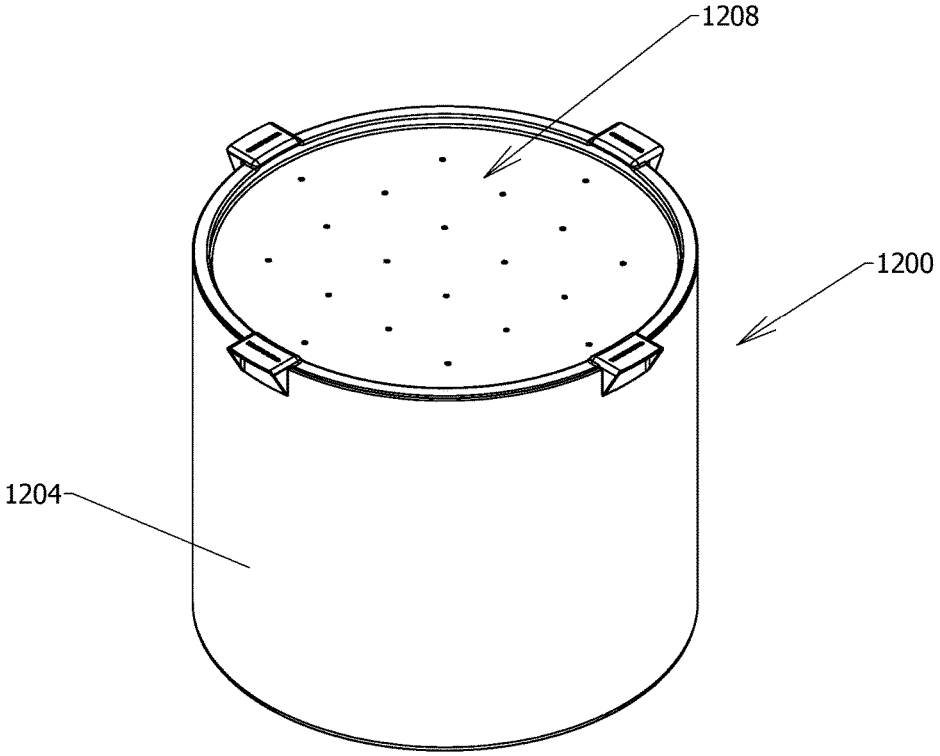
FIG. 12A is an isometric view of another alternative clear-ice-making device made in accordance with the present invention.
Figure 12B:
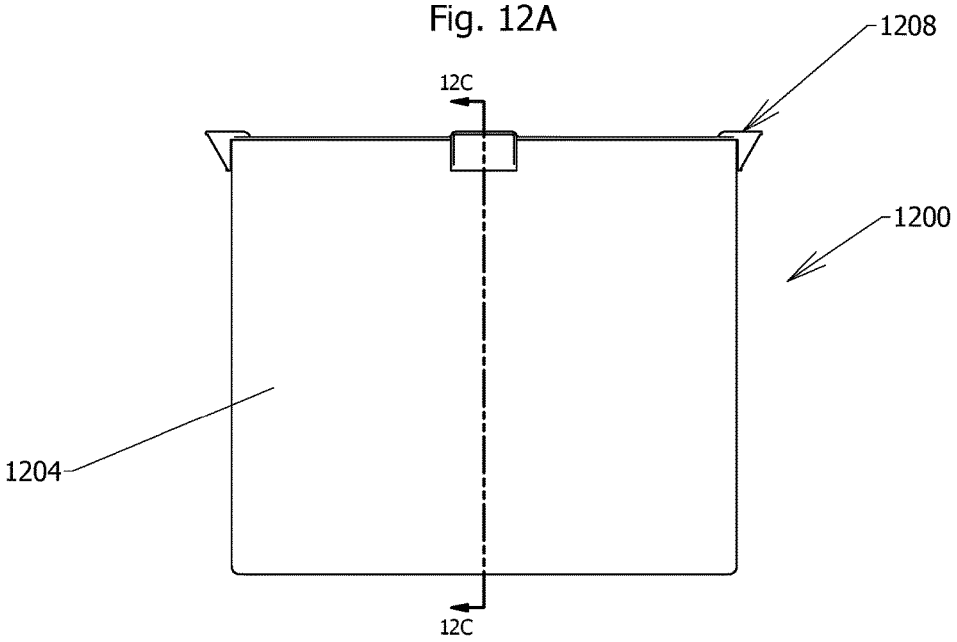
FIG. 12B is an elevational view of the clear-ice-making device of FIG. 12A.
Figure 12C:
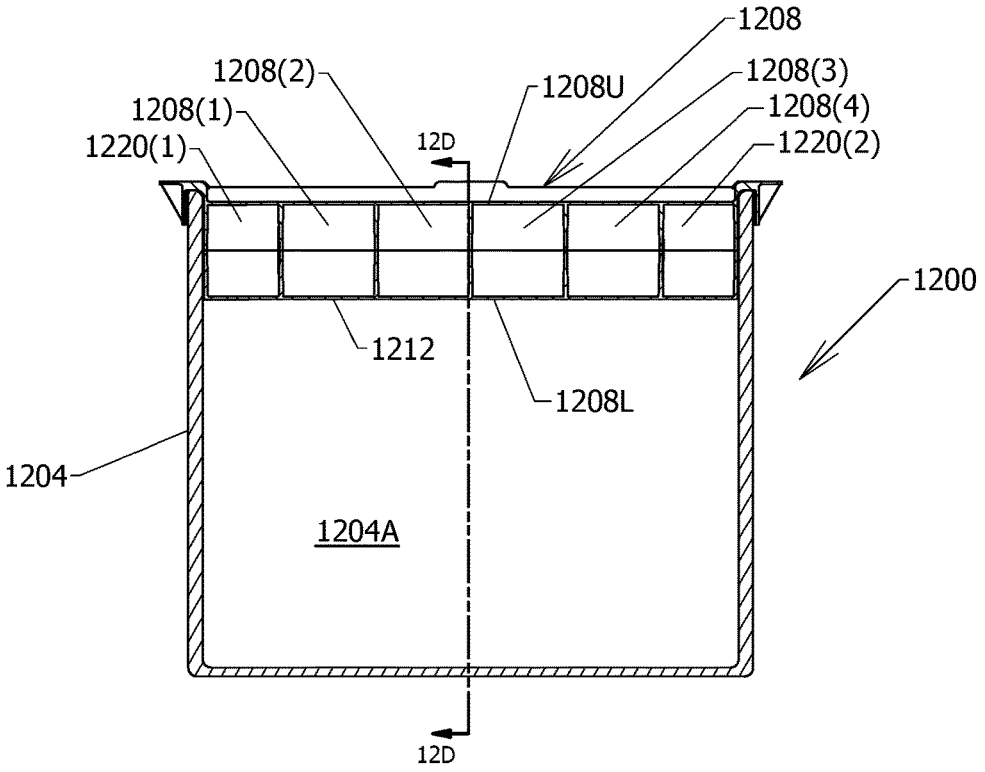
FIG. 12C is cross-section of the clear-ice-making device of FIG. 12A as taken along line 12C-12C of FIG. 12B.
Figure 12D:
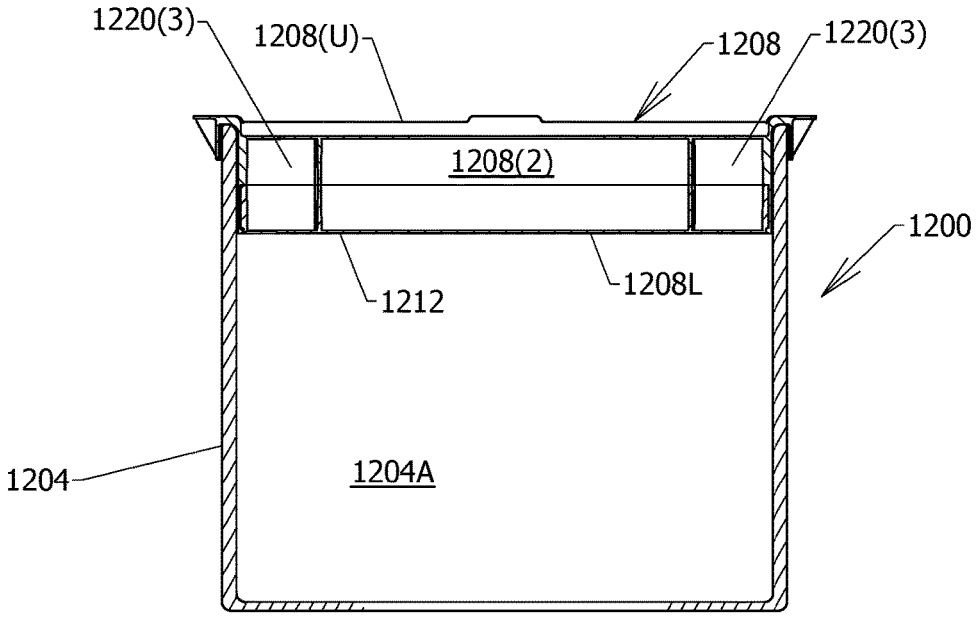
FIG. 12D is a cross-sectional view of the clear-ice-making device of FIG. 12A as taken along line 12D-12D of FIG. 12C.

FIGS. 12A to 12I illustrate a clear-ice-making device 1200 that is largely the same as clear-ice-making device 1100 of FIGS. 11A to 11H in that it includes an insulated vessel 1204 and a removable and rotatable ice mold 1208 located at the top of the insulated vessel so that the liquid within the cavities of the ice mold and within the void 1204A beneath the ice mold freezes from the top down for the reasons described above. The only difference in this example is that ice mold 1208 of FIGS. 12A and 12C to 12E has upper and lower mold halves 1208U and 1208L configured to define four rectilinear mold cavities 1208(1) to 1208(4) (FIG. 12C) for forming four corresponding right-rectangular clear-ice prisms (not shown) instead of the spherical mold cavities of ice mold 1108 of FIG. 11A, 11C, and 11D. As can be seen from FIGS. 12C, 12D, and 12I, the bottom surface 1212 of lower mold half 1208L is flat to facilitate the process of breaking the ice connections at the lower openings 1216(1) to 1216(16) (only a few labeled to avoid clutter) between the ice (not shown) in mold cavities 1208(1) to 1208(4) (FIG. 12C) and the ice (not shown) within void 1204A (FIGS. 12C and 12D). In this example, upper and lower mold halves 1208U and 1208(L) also include dead spaces 1220(1) to 1220(4) (FIGS. 12C and 12D) (which can produce useful clear ice shapes) and corresponding lower openings 1224(1) to 1224(12) (FIG. 12I) that function similarly to lower openings 1216(1) to 1216(16) and likewise will contain ice connections that need to be broken. Dead spaces 1220(1) to 1220(4) may be filled with liquid in this example to reduce buoyancy of ice mold 1208, but as noted above, the clear ice formed therein can be used, as well. In other embodiments dead spaces 1220(1) to 1220(4) may not be present and instead be occupied by material used to make ice mold 1208.

Figure 12E:
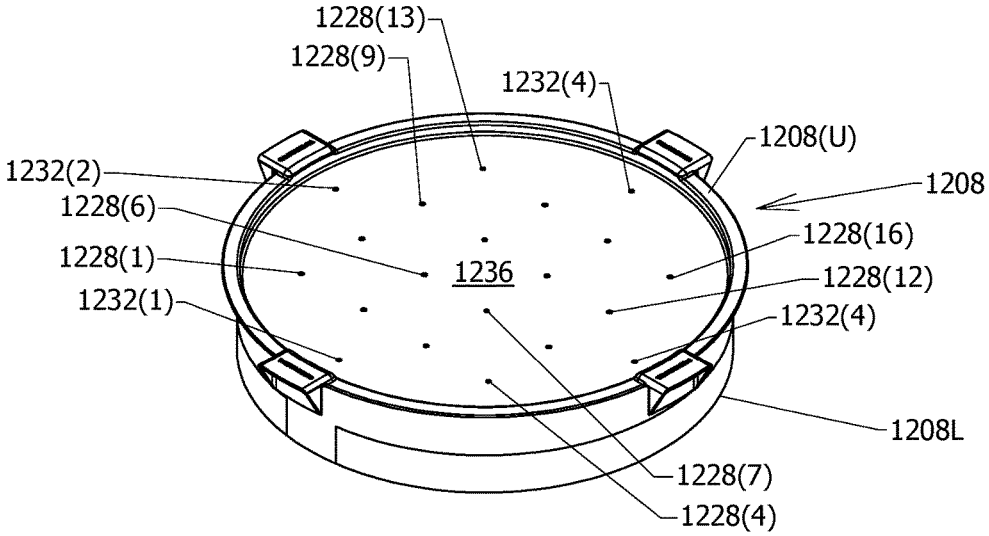
FIG. 12E is an enlarged perspective view of the ice mold of the clear-ice-making device of FIG. 12A.
Figure 12F:
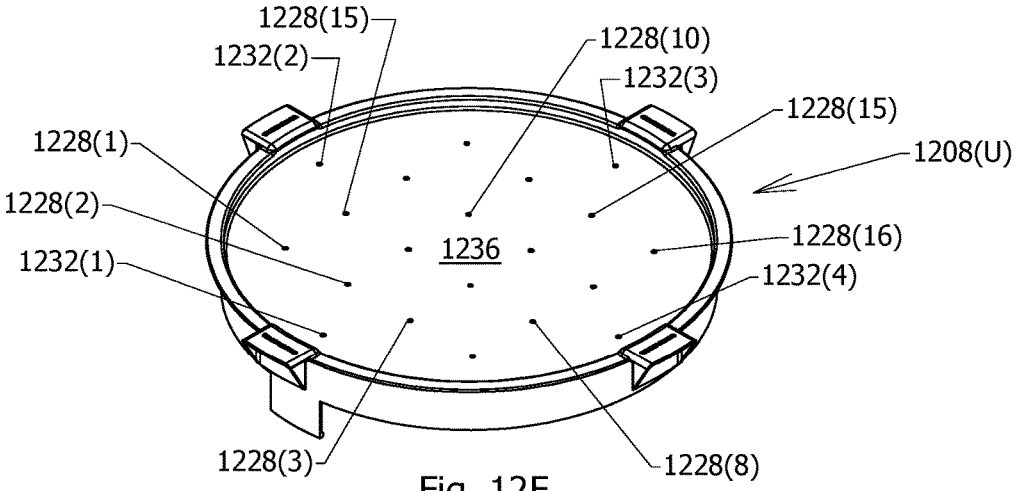
FIG. 12F is an enlarged top isometric view of the upper half mold of the ice mold of FIG. 12E.
Figure 12G:
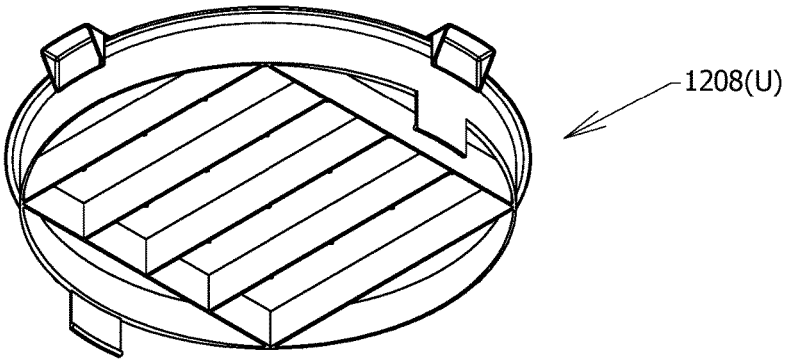
FIG. 12G is an enlarged bottom isometric view of the upper half mold of the ice mold of FIG. 12E.
Figure 12H:
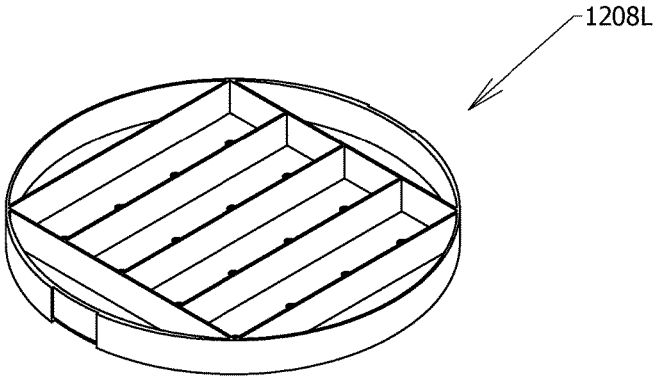
FIG. 12H is an enlarged top isometric view of the lower half mold of the ice mold of FIG. 12E.
Figure 12I:
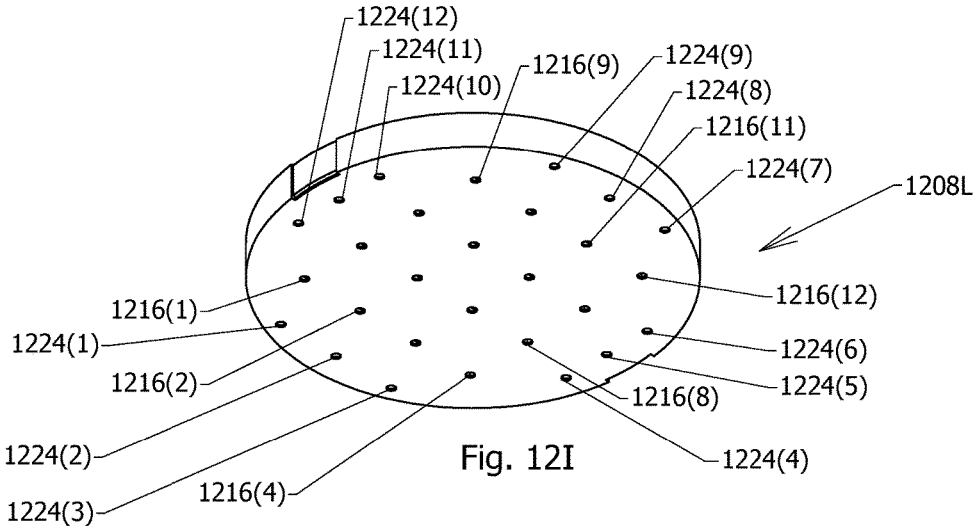
FIG. 12I is an enlarged bottom isometric view of the lower half mold of the ice mold of FIG. 12E.

As seen most clearly in FIGS. 12E and 12F, upper mold half 1208U includes upper openings 1228(1) to 1228(16) (only a few labeled to avoid clutter) that open into mold cavities 1208(1) to 1208(4) (FIG. 12C) and upper openings 1232(1) to 1232(4) that open into dead spaces 1220(1) to 1220(4) (FIGS. 12C and 12D). As also seen most clearly in FIGS. 12E and 12F, upper half mold 1208U includes a single overfill region 1236 that encompasses all of upper openings 1228(1) to 1228(16) and 1232(1) to 1232(4). The manner of using clear-ice-making device 1200 to make clear-ice shapes may be, for example, the same as or similar to any one or more of the manners of using clear-ice-making device 1100 described above. In addition, aspects and features of the components of clear-ice-making device 1200 may be the same as or similar to the corresponding aspects and features of like components of clear-ice-making device 1100.

It is noted that a number of variations for a clear-ice-making device having the rotating-mold extraction feature illustrated in FIGS. 1-10 and 11A through 12I are possible. For example, a clear-ice-making device (not shown) may include an insulated vessel having a rectangular transverse cross-sectional shape and a plurality of cylindrical cavities, with each cylindrical cavity receiving a corresponding multipart mold having a single cavity for making an individual clear-ice shape, such as a cube or ovoid, among others. In this manner, a user can make multiple clear-ice shapes at one time but extract them one at a time as needed. A benefit of single-cavity molds is that a single exit hole can be located at the vertical rotational center of the mold such that the force required to break the ice connection between the clear-ice shape and the cloudy ice in the space in the insulated vessel cavity below the mold is minimized. In this example, the ice connection would break via torsional shearing of the ice in or immediately adjacent to the exit hole.

It is noted that the term "half mold" has been used in the foregoing descriptions. This is a term of convenience and does not necessarily connote that it is exactly half of a mold. Rather, this term is intended to more generally mean a "mold part" that is separatable from another mold part to extract the one or more molded ice shapes from the one or more mold cavities defined by the mold parts.

CONCLUSION

Accordingly the reader will see that the example embodiments can create clear ice using a top down freezing method and can produce clear ice spheres, all without complex or expensive equipment.

Although the description above contains many specificities, these should not be construed as limiting the scope of the embodiments, but as merely providing illustrations of some of several embodiments. For example, cap 16 may have a different shape such as square, triangle, etc.; the half molds may mate vertically, horizontally, or at some angle in between; cup 50 may be removed, etc.

Thus the scope of the embodiments should be determined by the appended claims and their legal equivalents, rather than by the examples given.

The foregoing has been a detailed description of illustrative embodiments of the invention. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this invention.

Example embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A device for making shaped clear ice from a clear liquid, the device comprising:

an insulated vessel that includes insulated sides, an insulated bottom, and an open top, wherein the insulated sides and bottom define a vessel cavity having a depth;

an ice mold engageable into the vessel cavity through the open top of the insulated vessel, the ice mold including:

first and second mold parts that releasably engage one another to define at least one mold cavity that shapes the shaped clear ice upon freezing of the clear liquid within the at least one mold cavity;

an upper exterior end wall, the upper end having an upper opening allowing fluid communication through the upper exterior end wall to the at least one mold cavity for receiving the clear liquid during filling of the at least one mold cavity;

a lower exterior end wall spaced from the upper exterior end wall by a distance less than the vertical depth of the vessel cavity of the insulated vessel, the lower exterior end wall having lower opening allowing fluid communication through the lower exterior end wall to the at least one mold cavity;

a central rotational axis;

a lateral exterior extending between the upper and lower exterior end walls, the lateral exterior configured so that when the ice mold is engaged with the vessel cavity for ice-making, the ice mold is rotatable about the central rotational axis; and means that allow a user to rotate the ice mold relative to the insulated vessel about the central rotational axis while the ice mold is engaged in the vessel cavity;

wherein, when the ice mold is fully engaged in the vessel cavity, the lower exterior end of the ice mold is spaced from the insulated bottom so as to leave a void in the vessel cavity in which cloudy ice forms as a result of forming of the shaped clear ice within the at least one mold cavity.

2. The device according to claim 1, wherein the insulated vessel has a rim defining the open top, the ice mold further including a portion that hooks over the rim.

3. The device according to claim 2, wherein the portion that hooks over rim holds the ice mold in spaced relation to the insulated bottom of the insulated vessel.

4. The device according to claim 1, wherein the means for allowing a user to rotate the ice mold relative to the insulated vessel comprises the portion that hooks over the rim.

5. The device according to claim 1, wherein the lateral exterior of the ice mold is cylindrical in shape and the cavity of the insulated vessel is cylindrical in shape.

6. The device according to claim 1, wherein the ice mold is horizontally split.

7. The device according to claim 6, wherein when the first and second mold parts are releasable engaged with one another the first and second mold parts are rotationally locked together so as to rotate as a unit.

8. The device according to claim 7, wherein the ice mold includes a plurality of coupling mechanisms that rotationally lock the first and second mold parts together.

9. The device according to claim 8, wherein each coupling mechanism includes a catch structure on the first mold part and corresponding receiver on the second mold part.

10. The device according to claim 9, wherein the receiver includes a vertical recess for receiving a portion of the catch structure, wherein the portion of the catch structure and the vertical recess form a tight fit with one another so as to inhibit rotation between the first and second mold parts.

11. The device according to claim 1, wherein the ice mold is vertically split.

12. The device according to claim 1, wherein the at least one mold cavity is spherical.

13. The device according to claim 1, wherein the ice mold contains a plurality of mold cavities.

14. The device according to claim 1, wherein the lower end wall of the ice mold has a flat exterior bottom.

15. The device according to claim 1, wherein the ice mold includes an overfill region in fluid communication with the at least one mold cavity via the upper opening.

16. The device according to claim 1, wherein the ice mold defines a dead space and includes a lower opening that allows the dead space to fluidly communicate with the void of the insulated vessel when the ice mold is engaged with the insulated vessel.

17. The device according to claim 16, wherein the ice mold includes an upper opening in upper end wall that fluidly communicates with the dead space.

18. The device according to claim 16, wherein the first and second mold parts are upper and lower mold parts that, when engaged with one another, form the dead space.

19. A method of making shaped clear ice, the method comprising:

filling, with a clear liquid:

a mold cavity of an ice mold that is engaged with a vessel cavity of an insulated vessel; and a void in fluid communication with the mold cavity and located in the vessel cavity beneath the mold cavity;

placing the ice mold and the insulated vessel in a frigid environment so that an entirety of the clear liquid in the mold cavity freezes;

removing the ice mold and the insulated vessel from the frigid environment;

while the ice mold remains engaged with the vessel cavity, causing rotational movement between the ice mold and the insulated vessel to break a connection between ice in the mold cavity and ice in the void; and extracting the shaped clear ice from the ice mold.

20. A method, comprising providing a user with instructions for performing the steps of claim 19.

* * * * *